US008568157B2

(12) United States Patent
Bishop

(10) Patent No.: US 8,568,157 B2
(45) Date of Patent: Oct. 29, 2013

(54) CAP BODY INSULATION DISPLACEMENT CONNECTOR (IDC)

(75) Inventor: Peter Bishop, Cambs (GB)

(73) Assignee: AVX Corporation, Fountain Inn, SC (US)

( * ) Notice: Subject to any disclaimer, the term of this patent is extended or adjusted under 35 U.S.C. 154(b) by 0 days.

(21) Appl. No.: 13/407,938

(22) Filed: Feb. 29, 2012

(65) Prior Publication Data

US 2013/0224988 A1 Aug. 29, 2013

(51) Int. Cl.
*H01R 4/24* (2006.01)

(52) U.S. Cl.
USPC ..... 439/389

(58) Field of Classification Search
USPC ..... 439/389, 391, 395–404, 417, 441
See application file for complete search history.

(56) References Cited

U.S. PATENT DOCUMENTS

| | | | | |
|---|---|---|---|---|
| 3,854,114 | A | | 12/1974 | Kloth et al. |
| 4,068,912 | A | | 1/1978 | Hudson, Jr. et al. |
| 4,227,763 | A | | 10/1980 | Marks |
| 4,533,199 | A | | 8/1985 | Feldberg |
| 4,668,039 | A | | 5/1987 | Marzili |
| 4,701,001 | A | | 10/1987 | Verhoeven |
| 4,836,803 | A | | 6/1989 | Seidel |
| 5,120,244 | A | | 6/1992 | Saito et al. |
| 5,188,536 | A | | 2/1993 | Ganthier et al. |
| 5,199,896 | A | | 4/1993 | Mosquera |
| 5,478,248 | A | | 12/1995 | Mitra et al. |
| 5,549,484 | A | | 8/1996 | Chen |
| 5,551,889 | A | | 9/1996 | Kozel et al. |
| 5,577,930 | A | * | 11/1996 | Dahlem et al. ..... 439/399 |
| 5,616,047 | A | | 4/1997 | Lutsch |
| 5,997,337 | A | | 12/1999 | Torii |
| 6,007,366 | A | | 12/1999 | Torii et al. |
| 6,019,637 | A | | 2/2000 | Iwata et al. |
| 6,050,845 | A | * | 4/2000 | Smalley et al. ..... 439/417 |
| 6,093,048 | A | | 7/2000 | Arnett et al. |
| 6,135,821 | A | * | 10/2000 | Liu ..... 439/676 |
| 6,285,815 | B1 | | 9/2001 | Daoud |

(Continued)

FOREIGN PATENT DOCUMENTS

| | | |
|---|---|---|
| EP | 0 228 750 | 7/1987 |
| EP | 0 411 859 | 2/1991 |
| WO | WO-2011/076185 | 6/2011 |

OTHER PUBLICATIONS

Related U.S. Appl. No. 13/349,148, filed Jan. 12, 2012.

(Continued)

*Primary Examiner* — Jean F Duverne
(74) *Attorney, Agent, or Firm* — Foley & Lardner, LLP

(57) ABSTRACT

A single molding electrical insulation displacement connector assembly includes a cap body having a passage therethrough at a contact position for receipt of an insulated conductive core wire. A contact element is movably retained in the cap body with a first insulation displacement end defined by opposed blades and a second opposite end configured for electrical contact with a printed circuit board. The contact element is movable relative to the cap body from a first position wherein the opposed blades do not block insertion of the wire into the passage to a second position wherein the opposed blades engage the wire. The wire is initially inserted into the cap body through the passage with the contact element in the first position. The cap body is subsequently pressed towards the second end of the contact element causing the opposed blades to slide within the cap body and engage the wire.

20 Claims, 6 Drawing Sheets

(56) References Cited

U.S. PATENT DOCUMENTS

| | | | | |
|---|---|---|---|---|
| 6,837,737 | B2 | 1/2005 | Baier et al. | |
| 7,320,616 | B1 * | 1/2008 | Legrady et al. | 439/404 |
| 7,503,797 | B2 | 3/2009 | Lappoehn | |
| 7,780,468 | B1 | 8/2010 | Bishop | |
| 7,833,045 | B2 | 11/2010 | Bishop | |
| 7,931,489 | B2 | 4/2011 | Bishop | |
| 7,976,334 | B2 | 7/2011 | Bishop | |
| 8,109,783 | B2 | 2/2012 | Bishop et al. | |
| 8,192,223 | B2 | 6/2012 | Bishop | |
| 8,262,405 | B1 | 9/2012 | Bishop | |
| 2006/0189174 | A1 | 8/2006 | Fabian et al. | |
| 2009/0239409 | A1 | 9/2009 | Bishop | |

OTHER PUBLICATIONS

Jaycar Electronics Reference Data Sheet: idconnj.pdf (1) "IDC Cable, Headers, & Connectors", 2004.

http://www.etco.com/releases: Press Release:"IDC Terminals Provide One-Step Attachment", 2006.

http://www.wppltd.demon.co.uk/wpp/wiring/uktelephone/installation/installation.html: Tools & Installation: TOLS, Feb. 24, 2008.

Extended Search Report issued in European Patent Application No. 13157116.8-1801 dated Jun. 5, 2013 (8 pages).

* cited by examiner

CAP BODY INSULATION DISPLACEMENT CONNECTOR (IDC)

FIELD OF THE INVENTION

The present invention relates generally to the field of electrical connectors, and more particularly to a capped insulation displacement connectors (IDC) used to connect one or more insulated wires to a component, such as a printed circuit board (PCB).

BACKGROUND

Insulation displacement connectors (IDC) are well known in the art for forming connections between an insulated wire and any manner of electronic component. These connectors are typically available as sockets, plugs, and shrouded headers in a vast range of sizes, pitches, and plating options. A common feature of IDCs is one or more contact elements incorporating a set of blades or jaws that cut through the insulation around the wire and make electrical contact with the conductive core in a one-step process, thus eliminating the need for wire stripping and crimping, or other wire preparation. IDCs are used extensively in the telecommunications industry, and are becoming more widely used in printed circuit board (PCB) applications.

U.S. Pat. No. 6,050,845 describes an IDC assembly that can be mounted and secured to a circuit board prior to terminating conductors to the connector. The electrical connector includes a housing having at least one conductor-receiving aperture and an associated terminal-receiving passageway extending from a board mounting face and intersecting each conductor-receiving aperture. A terminal is disposed in each terminal-receiving passageway and includes a body portion having a first connecting section extending from one end and adapted to be inserted in a through-hole of a circuit board, and a pair of upstanding arms defining an IDC slot for receipt of a wire. Each terminal is partially inserted into the housing in a first position such that a portion of the terminal body and the first connecting section extends below the board mounting face of the housing. Upon positioning the first connecting sections in corresponding through-holes of a circuit board, the terminals can be secured to the board, after which ends of insulated conductors can be inserted into respective conductor-receiving apertures and terminated therein to respective terminals by moving the housing toward the board to a second position against the board and simultaneously pushing all the corresponding wires into respective IDC slots.

Attempts have been made to configure IDCs for surface mounting technology (SMT) applications as well. For example, U.S. Pat. No. 7,320,616 describes an IDC specifically configured for SMT mounting to a PCB. The connector assembly has at least one contact member with a piercing, cutting or slicing end that is slideably disposed within a main body, and a mounting end that extends from the main body and is attached to a printed circuit board using conventional SMT processes. An insulated conductor, such as a wire, cable and/or ribbon, is inserted in a channel in the main body without being pierced by the piercing end of the contact. When a user pushes down on the top portion of the main body, the contact slides into the channel and pierces the insulated conductor. The top portion of the main body also provides a surface for a vacuum pick-up nozzle in an automated pick-and-place assembly process.

The IDCs in the above cited references are relatively complicated in that they require all or a portion of the main body to be movable or slidable relative to the contacts to make final connection with the wires after ends of the contacts have been inserted into through holes in the PCB or surface mounted to the PCB. In addition, a perception to some in the industry is that IDCs are not well suited for stressful environments wherein the electrical component is subjected to prolonged shock and vibrations because the wires tend to move or pull out of the contact blades.

AVX Corporation having a principal place of business at Fountain Inn, S.C., USA, provides a discrete wire-to-board IDC (Series 9175/9176/9177) that has provided significant benefits and advantages to IDC applications. This connector is available in various pin configurations and is SMT assembled to a PCB prior to assembly of the wires. A small application hand tool is used to insert the wires into the respective contact slots. This process cuts the insulation and enables the individual wire conductors to form a homogeneous joint. U.S. Pat. No. 7,976,334 describes a further improvement that is particularly suited for (but not limited to) the AVX Series 9175/9176/9177 connectors discussed above. The connector assembly of the '334 patent includes one or more contact elements stationarily fixed in an insulator body, with opposed blades or jaws of the contact elements aligned with channels in the body. A cap is configured to engage over the body and includes recesses with an open bottom that align with the body channels. The cap serves the function of a tool for inserting wires into the contact elements, for example between the opposed blades or jaws of the elements. The cap may also serve the optional feature of covering and protecting the contacts, and to prevent inadvertent removal or pulling out of the wires from the contact elements. The cap may also serve to cover and protect the open ends of live wires inserted in the connector assembly. Although a significant advancement in the art, this connector assembly according to the '334 patent requires two separate insulator material moldings, namely the body and the cap, which adds to the overall cost of the connector assembly.

A welcome improvement in the art would be a connector assembly that incorporates the benefits of the '334 patent discussed above without the complication and expense of separate moldings.

SUMMARY

Objects and advantages of the invention will be set forth in part in the following description, or may be obvious from the description, or may be learned through practice of the invention.

In accordance with aspects of the invention, a single molding electrical insulation displacement connector assembly is provided that is particularly well suited for connecting one or more insulated conductive core wires to a PCB. It should be appreciated, however, that connectors according to the invention are not limited to this use. The connector assembly is a "single molding" in that it does not utilize two separate insulator molding components, such as a body in which contact elements are embedded or otherwise retained and a separate cap that engages onto the body. The connector assembly includes a cap body (the sole "molding") formed from any conventional insulator material. The body can take on various shapes and sizes, but generally includes a top surface, side walls, end walls, and a generally open bottom. The cap body has at least one passage defined in at least one of the side walls through which an insulated core wire can be inserted into the cap body.

At least one contact element is movably retained in the cap body with a first insulation displacement end defined by opposed blades oriented transversely to the passage. The blades define a slot or notch for receipt of the insulated core wire therein. As understood by those skilled in the art, the slot is dimensioned such that when an insulated wire is pressed into the slot, the blades cut through the insulation and make electrical contact with the wire core. A second end of the contact element extends from the open bottom of the body and is configured to make an electrical connection with another component, such as a PCB. For example, the second end of the contact element may be configured with plated through-hole terminations intended to be pressed into through-holes in the PCB. In another embodiment, the second end may be bent into an electrical contact tail or foot that is configured to be soldered to a corresponding contact pad element on the PCB. The method and configuration by which the connector assembly is mated to another component is not a limiting factor of the inventive connector.

The contact element is movable relative to cap body from a first position wherein the opposed blades do not block insertion of the insulated core wire into the cap body through the passage to a second position wherein the opposed blades engage the insulated core wire. With this configuration, the second end of the contact element is first mounted to the PCB with the contact element in the first position relative to the cap body. The insulated core wire is then inserted into the cap body through the passage. The cap body is subsequently pressed towards the second end of the contact element causing the opposed blades to slide within the cap body and engage the insulated core wire. Thus, the cap body serves the function of a tool for aligning, retaining, and inserting the wires between the opposed blades or jaws of the elements. The cap also serves to cover and protect the contacts, and to prevent inadvertent removal or pulling out of the wires from the contact elements. The cap also covers and protects the open ends of live wires inserted in the connector assembly.

The connector assembly may be configured as a through-wire connector wherein a passage is defined in each of the cap body side walls such that a wire can pass completely through the connector assembly for any manner of further purpose. In another embodiment, the connector assembly is configured as a wire termination connector, wherein a passage is defined in only one of the cap body side walls such that a wire cannot pass through connector assembly.

Desirably, the connector assembly is configured for conventional pick-and-place manufacturing processes. In this regard, the cap body may have at least one surface that is suited as a pick-up surface for vacuum nozzle. For example, the top surface of the cap body may have sufficient surface area to serve as a pick-up surface.

The connector assembly is not limited to any particular number of passages and associated contact elements. In one embodiment, the connector assembly may be a single wire connector. In other embodiments, the connector assembly may be a two-wire connector and include two channels and associated contact elements. The connector assembly may be configured to accommodate three or more wires in still further embodiments.

In certain embodiments, engaging locking structure is provided between the cap body and contact element that prevents inadvertent removal of the cap body from the contact element in the first position of the contact element yet allows sliding movement of the contact element with the cap body to the second position. For example, the contact element may slide within a groove defined internally within the cap body, with the locking structure including a first set of barbs defined on the opposed blades that engage the walls of the groove. A second set of barbs may be defined on the opposed blades spaced from the first set of barbs at a distance so as to engage the cap body within the groove at the second position of the contact element.

The connector assembly may have a single contact element is disposed at each of the contact positions that mounts to a respective pad or through-hole on the PCB. In an alternate embodiment, a pair of contact elements are disposed at each contact position with contact feet at the respective second ends for surface mounting to a common pad on the PCB.

The present invention also encompasses a PCB assembly that includes one or more of the connector assemblies discussed herein. For example, an exemplary PCB assembly may include a printed circuit board having a contact pad or through-hole footprint defined thereon. At least one of the electrical insulation displacement connector assemblies discussed above is mounted on the PCB. The second end of the contact elements extending from the connector body are configured for mating with the footprint on the PCB.

Particular embodiments of the unique insulation displacement connectors are described in greater detail below by reference to the examples illustrated in the drawings.

DETAILED DESCRIPTION

Figure 1:
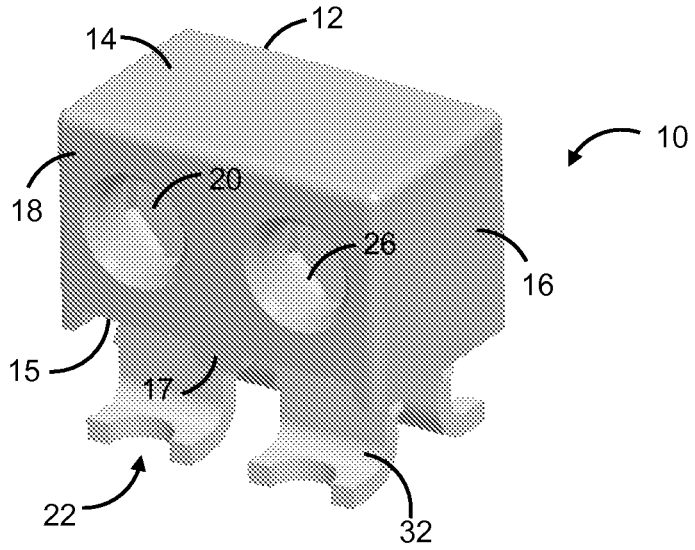
FIG. 1 is a perspective view of an embodiment of a connector assembly according to the invention illustrating the cap body and contact elements in the first position.

Reference will now be made to embodiments of the invention, one or more examples of which are illustrated in the figures. The embodiments are provided by way of explanation of the invention, and are not meant as a limitation of the invention. For example, features illustrated or described as part of one embodiment may be used with another embodiment to yield still a further embodiment. It is intended that the present invention encompass these and other modifications and variations as come within the scope and spirit of the invention.

FIGS. 1 through 4 depict a first embodiment of an insulation displacement connector (IDC) connector assembly 10 in accordance with aspects of the invention is illustrated. The connector assembly 10 includes a cap body 12 configured for mounting on a printed circuit board (PCB) 50 (FIG. 2) by any conventional mounting technique. The connector assembly 10 in accordance with the invention is particularly well suited for connecting one or more insulated conductive wires 44 (FIGS. 3 and 4) to the PCB 58. It should be appreciated, however, that a connector assembly 10 in accordance with the invention is limited to this use.

The cap body 12 (also referred to as a molding, or insulator) is formed from any conventional insulator material, such as UL94VO Nylon. Other suitable materials are also known in the art. The cap body 12 is the sole molding component of the connector assembly 10, and does not mount onto or otherwise engage with another molding component. The cap body 12 can take on various shapes and sizes, but generally includes a top 14, bottom 15, end walls 16 and longitudinally extending side walls 18. The cap body 12 may have a generally rectangular configuration as illustrated in the figures, or any other suitable shape.

Figure 9:
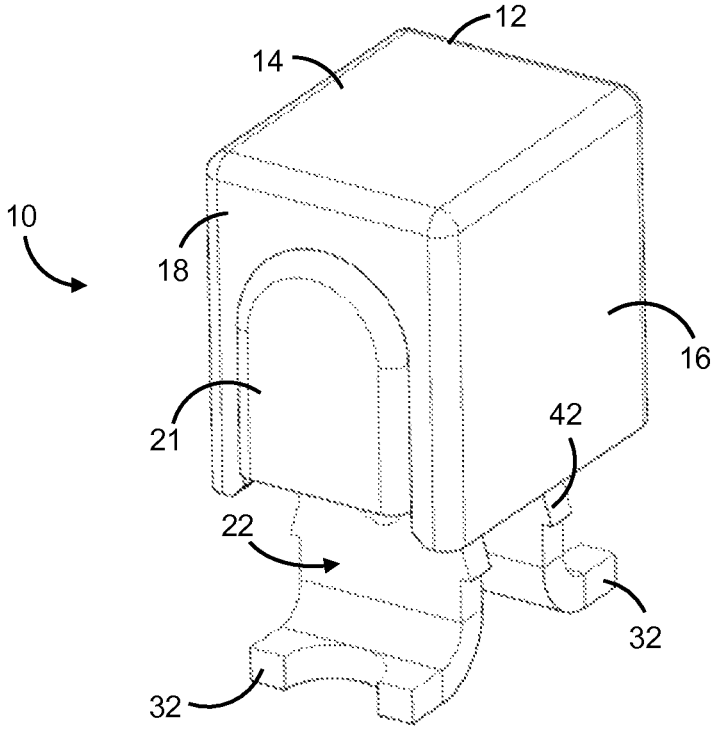
FIG. 9 is a perspective assembled view of a single-wire embodiment of a connector assembly.
Figure 10:
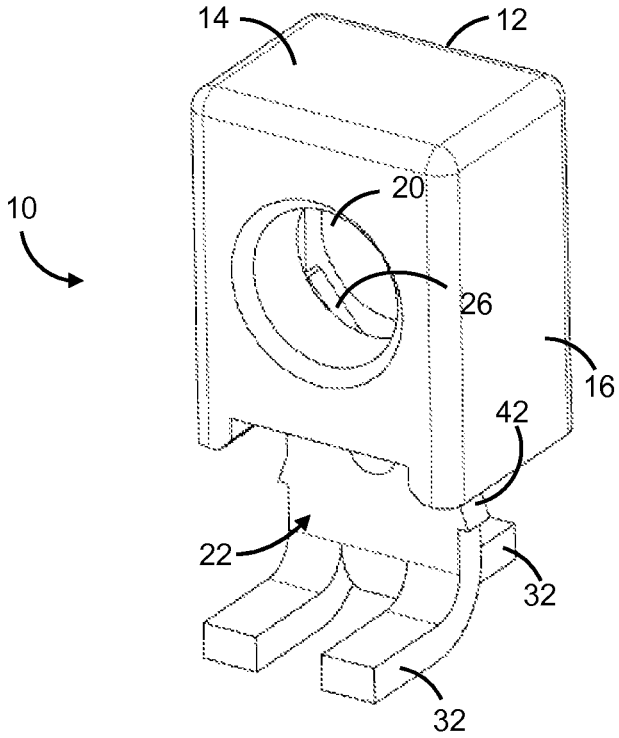
FIG. 10 is a perspective assembled view of a different single-wire embodiment of a connector assembly.
Figure 11:
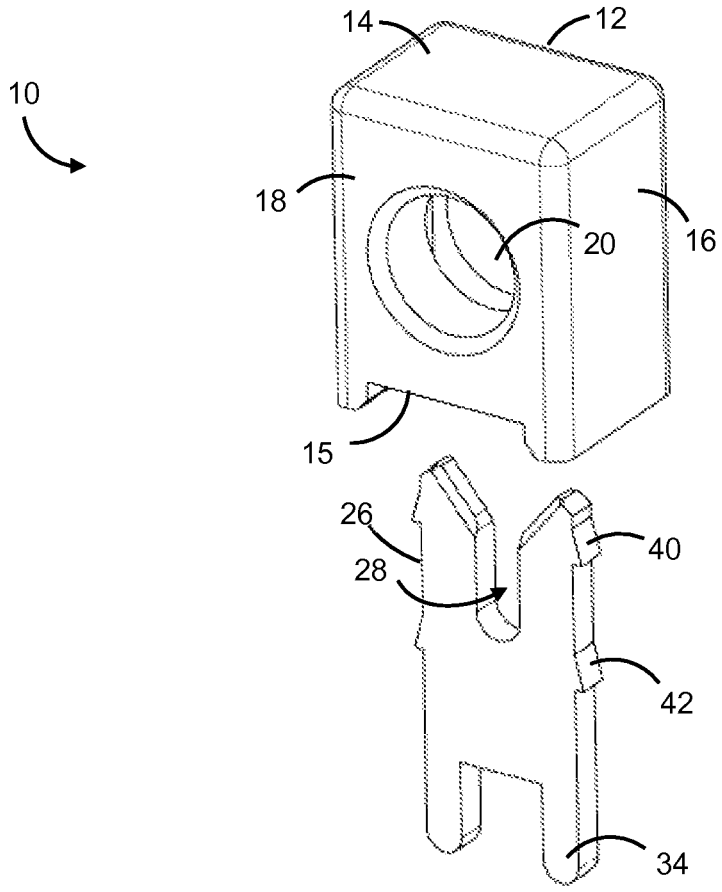
FIG. 11 is a perspective component view of a single-wire through-hole mount connector assembly.

The cap body 12 has at least one passage 20 defined in at least one of the side walls 18 for receipt of an insulated conductive core wire 44 that is inserted into the cap body 12 through the passage 20, which may have a circular cross-sectional shape or other suitable profile. In the embodiment of FIGS. 1 through 4, the connector assembly 10 is configured as a multi-wire (e.g., two or more wires) connector and the cap body 12 includes two passages 20 for receipt of separate conductive core wires 44. In alternate embodiments, for example as depicted in FIGS. 9 through 11, the connector assembly 10 may be a single wire connector.

Figure 5:
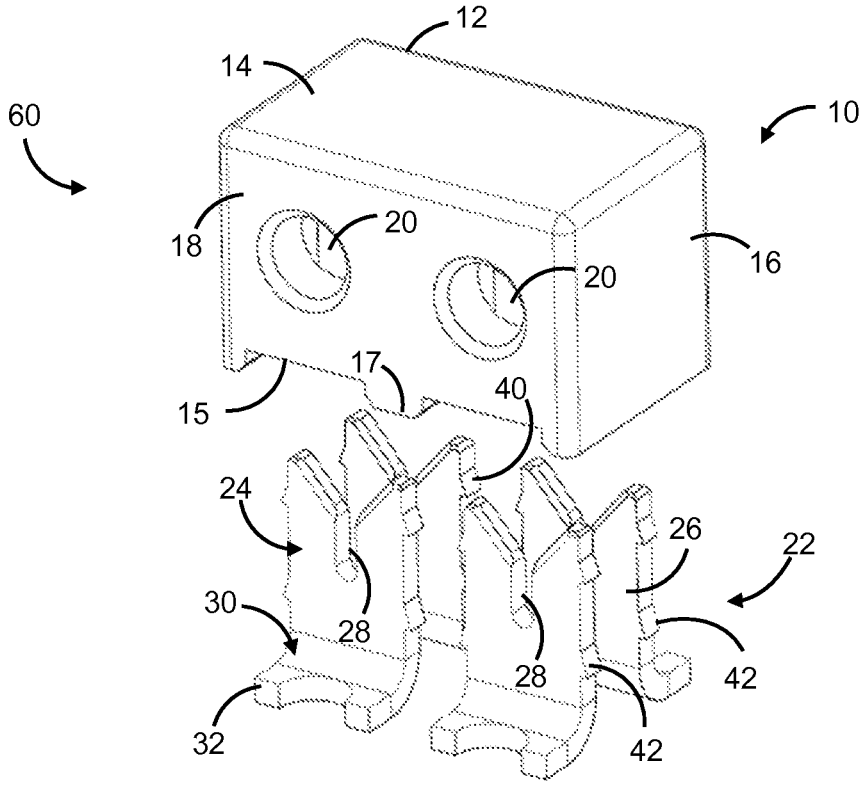
FIG. 5 is a perspective component view of an alternative embodiment of a connector assembly according to the invention.

Referring to the various figures in general, at least one contact element 22 is movably retained in the cap body 12. The contact element 22 is formed from any suitable electrically conductive material used in the art for connector contact elements, and includes a first insulation displacement end 24 (FIG. 5) that is oriented transversely relative to a respective passage 20. This end 24 is uniquely configured for making electrical contact with the conductive core 48 of a wire 44 inserted through the passage 20. In the illustrated embodiments, the first insulation displacement end 24 includes opposed blades 26 that define a slot 28 for receipt of the insulated core wire 44 therein. The slot 28 is dimensioned such that when an insulated wire 44 of a certain gauge is pressed into the slot 28, the blades 26 cut through the insulation component 46 and make electrical contact with the wire core 48. Thus, the slot 28 has a width that corresponds generally to the diameter of the conductive core 48 of the wire. In the illustrated embodiments, the blades 26 define a generally U-shaped slot 28. However, this configuration of the blades 26 and slot 28 is not a limiting factor. Various configurations of contact elements used for insulation displacement connectors are known and understood by those skilled in the art, and any one of these configurations may be used in a connector assembly 10 within the scope and spirit of the invention.

Figure 2:
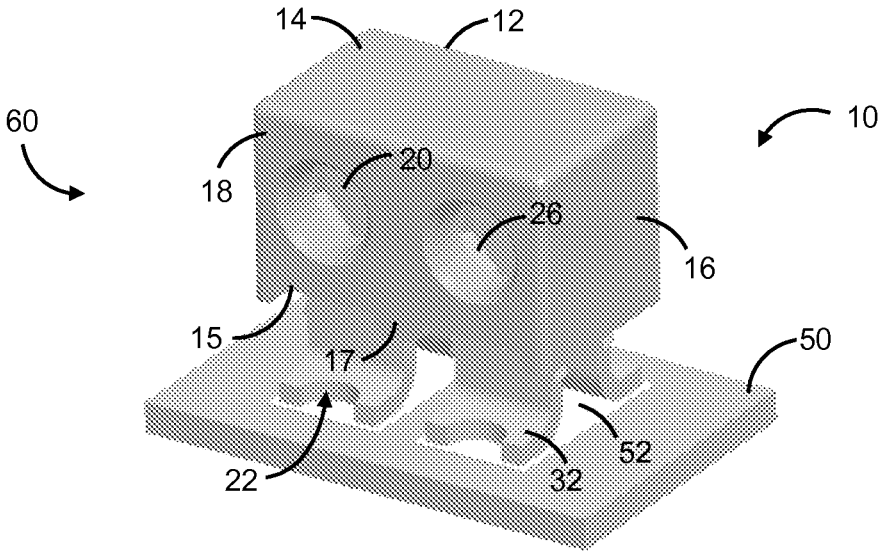
FIG. 2 is a perspective view of the embodiment of FIG. 1 surface mounted to a PCB with the contact elements still in the first position.
Figure 3:
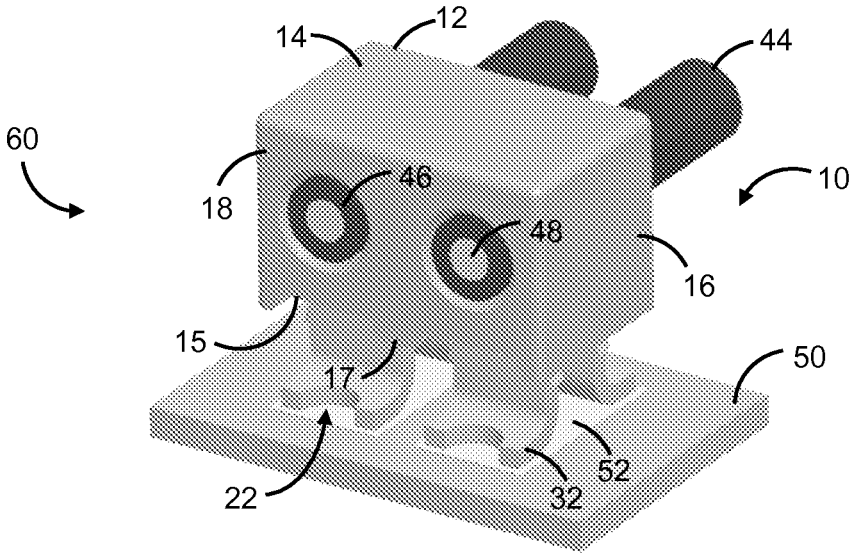
FIG. 3 is a perspective view of the embodiment of FIG. 2 with insulated core wires inserted into the cap body with the contact elements still in the first position.
Figure 12:
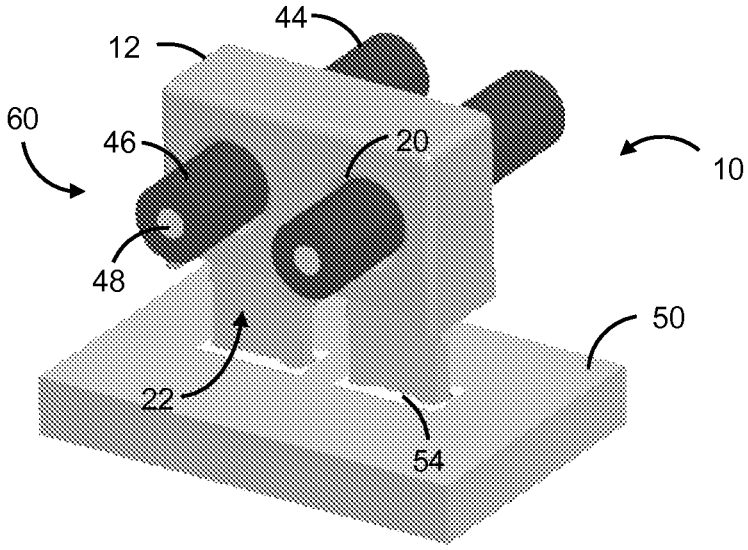
FIG. 12 is a perspective assembled view of a multi-wire through-hole mount connector assembly mounted to a PCB in the first position.

A second end 30 of the contact element 22 extends from the bottom surface 15 of the cap body 12, for example through an opening, slot, or other access in the bottom 15, and is configured to make an electrical connection with another component, for example a contact pad 52 the printed circuit board 50 (FIG. 2). The second end 30 may take on various configurations depending on the particular type of electrical connection to be made with the circuit board 50 or other component. For example, the second end 30 of the contact element 22 may be configured as a bayonet, post, or other type of through-hole termination 34 (FIGS. 11 and 12) intended to be pressed into a through-hole connection 54 in the circuit board 50. In other embodiments (e.g. FIGS. 1 through 4), the second end 30 of the contact element 22 is bent or otherwise formed into a tail 32 that is configured for surface mounting onto a corresponding contact pad 52 on the circuit board 50. These various types of connections are well known to those skilled in the art and need not be described in detail herein. It should be appreciated that the method and configuration by which the contact elements 22 are mated to a circuit board 50 or other component is not a limiting factor of the invention.

Figure 4:
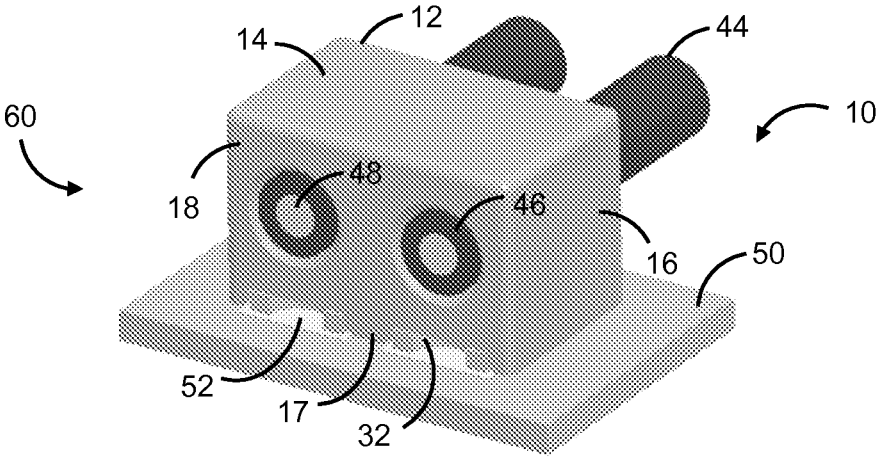
FIG. 4 is a perspective view of the embodiment of FIG. 3 with the cap body pushed down onto the contact elements.

Referring again to FIGS. 1 through 4, the contact elements 22 are movable within the cap body 12 from a first position (FIGS. 1 and 2) wherein the opposed blades 26 do not block insertion of the insulated core wire 44 into the cap body 12 through the passage 20. Once the wires 44 are inserted (FIG. 3), the contact elements 22 are movable to a second position depicted in FIG. 4 wherein the opposed blades 26 move across the passage 20 and engage the insulated core wire 44. In particular, the blades 26 cut through the insulation 46 and contact the conductive core 48, as discussed above. Movement of the blades 22 within the cap body 12 may be variously achieved. For example, in the illustrated embodiment of FIGS. 1 through 4, the second end of the contact elements 22 are first mounted to the PCB 50 with the contact elements 22 in the first position relative to the cap body 12. The insulated core wires 44 are then inserted into the cap body 12 through the respective passages 20. The cap body 12 is then pressed towards the second end 30 of the contact elements 22 resulting in the opposed blades 26 sliding within the cap body 12 and engaging the insulated core wire 44, as depicted in FIG. 4.

It should thus be appreciated that the cap body 12 serves the function of a tool for initially aligning, retaining, and pressing the insulated conductive core wires 44 between the opposed blades 26 of the contact elements 22. The cap body 12 also serves to cover and protect the contacts 22, and to prevent inadvertent removal or pulling out of the wires 44 from the contact elements 22. The cap body 12 also covers and protects the open ends of live wires inserted in the connector assembly 10.

In certain embodiments as depicted in FIGS. 7, 8, and 10 through 12, a single contact element 22 is disposed at each contact position in the cap body 12. These single contacts may have oppositely oriented contact tails 32 defined at the second end thereof for surface mounting to a contact pad 52 on a PCB 50, or through-hole terminations 34 for insertion into through-hole connections 54 in the PCB 50.

In other embodiments as depicted in FIGS. 1 through 6 and 9, multiple contact elements 22 may be disposed at each of the contact positions in the cap body 12. For example, a pair of the contact elements 22 may be provided at each position, with each contact element having contact tails 32 oriented in one direction, as particularly seen in FIGS. 5 and 6.

As seen in FIGS. 1 through 4, and 12, the connector assembly 10 may be configured as a through-wire connector wherein a respective passage 20 is defined in each of the cap body side walls 18 such that a wire 44 can pass completely through the connector assembly 10 for any manner of further purpose.

Figure 8:
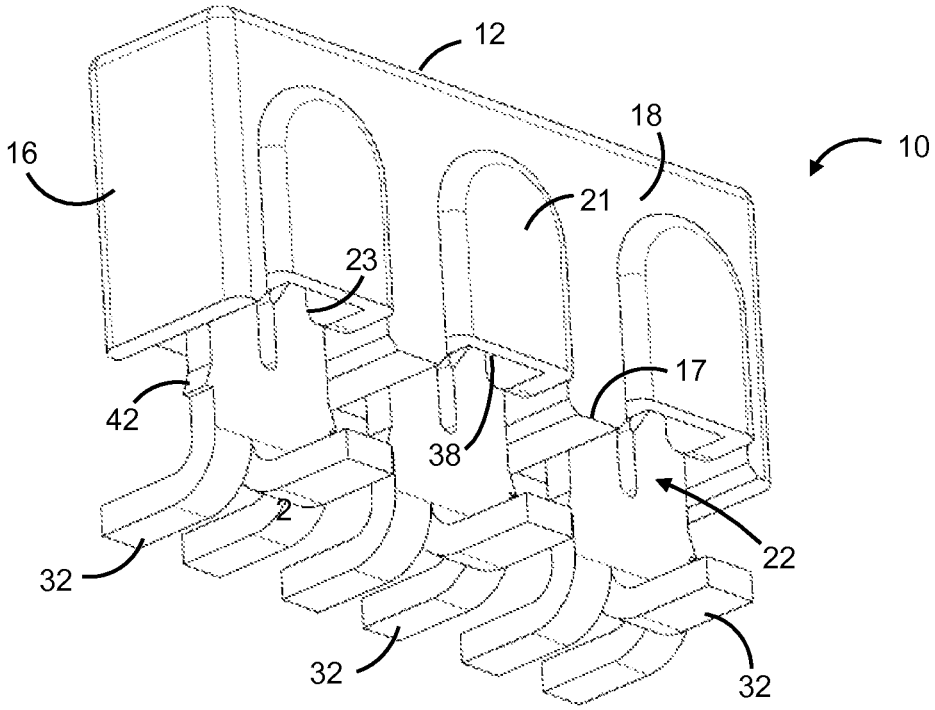
FIG. 8 is a perspective assembled view of still a different embodiment of a connector assembly.

In other embodiments as seen in FIGS. 8 and 9, the connector assembly 10 is configured as a wire termination connector, wherein a passage 20 is defined in only one of the cap body side walls 18 with the other side wall 18 being blocked, for example by a pronounced structure 21 or flat side wall 18, such that a wire 44 cannot pass through connector assembly 10.

Desirably, the connector assembly 10 is configured for conventional pick-and-place manufacturing processes. In this regard, the cap body 12 and contact elements 22 in the first position relative to the cap body 12 may be supplied in a reel form with the top surface 14 being suitable as a pick-up surface for vacuum nozzle. The assemblies 10 are placed for conventional mounting to the PCB 50 (or other component) as depicted in FIG. 2 prior to insertion of the wires 44 into the passages 20.

Figure 6:
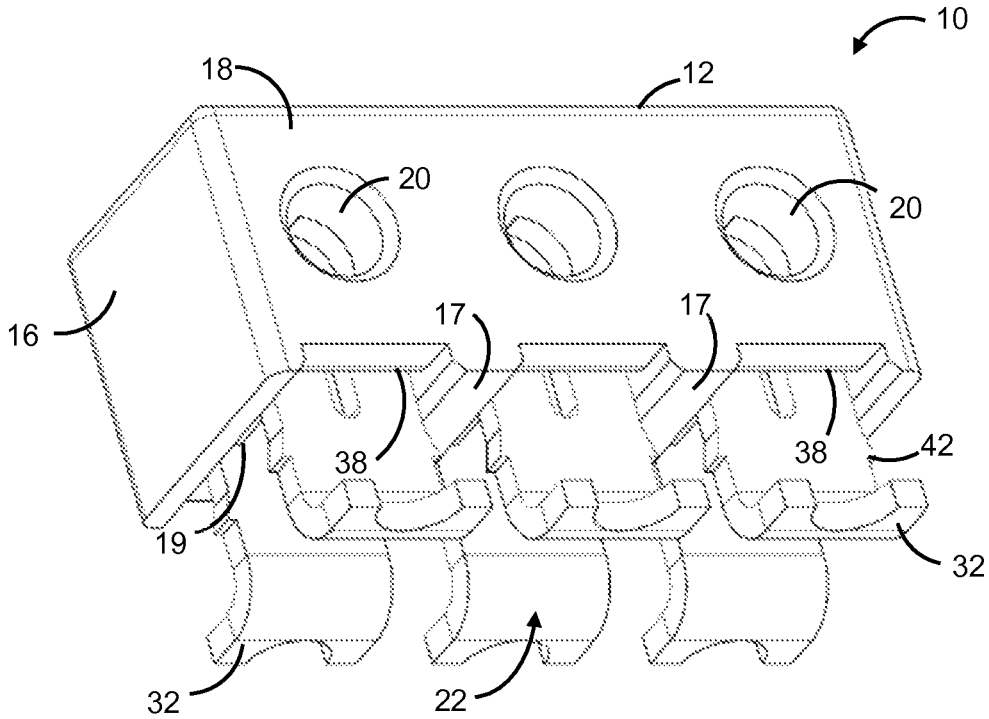
FIG. 6 is a perspective assembled view of still another embodiment of a connector assembly.
Figure 7:
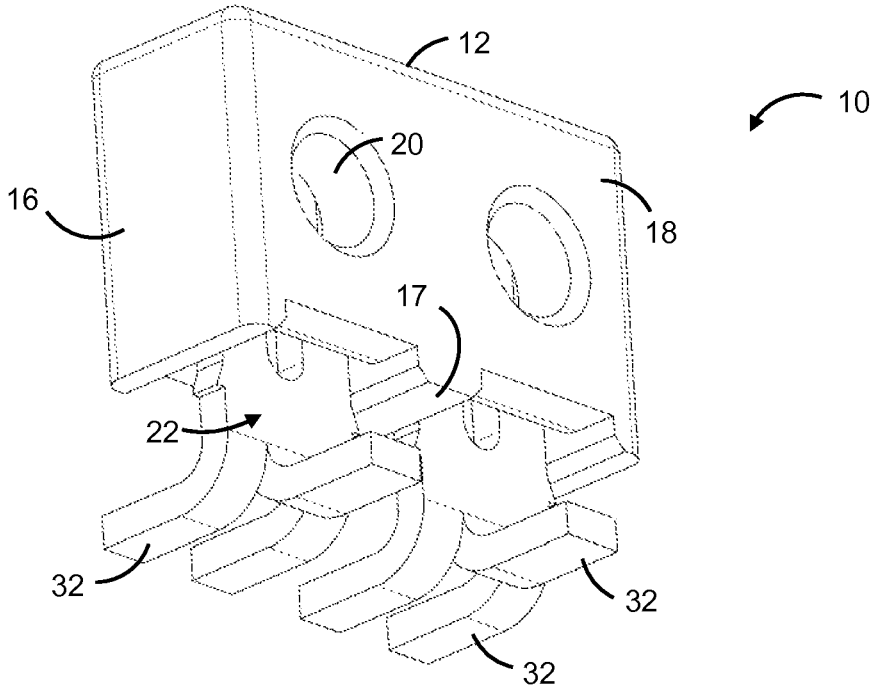
FIG. 7 is a perspective assembled view of another embodiment of a connector assembly according to the invention.

Engaging locking structure is provided between the cap body 12 and contact element 22 to prevent inadvertent removal of the cap body 12 from the contact elements 22 in the first position of the contact element yet allow sliding movement of the contact elements 22 within the cap body 12 to the second position. Referring particularly to FIGS. 6 and 8, the contact elements 22 may slide within a groove 38 defined by any manner of internal structure within the cap body 12, including intermediate walls 17 that extend between the side walls 18, engagement walls or shoulders 23 (FIG. 8), or intermediate walls 19 (FIG. 6) that separate contact element pairs at the respective contact positions.

The engaging locking structure may also include a first set of barbs 40 defined on the opposed blades 26 that engage the groove structure or walls in the first position of the contact elements 22. This set of barbs 40 is positioned and configured on the blades 26 to prevent inadvertent removal of the cap body 12 while the blades 26 are in a position so as to allow free passage of a wire 44 through the passage 20. The first set of bards 40 provide some degree of resistance to movement of the cap body 12 relative to the contact elements 22, but allow for pressing of the cap body 12 from the position in FIG. 3 to the position in FIG. 4.

A second set of barbs 42 may be defined on the opposed blades 26 spaced from the first set of barbs 40 at a distance so as to further engage the groove structure at the second position of the contact element when the cap body 12 is pressed into the position of FIG. 4. The second set of barbs serve to further "lock" the cap body 12 onto the contact elements 22. It should be appreciated, however, that the second set of barbs may not be needed, and that a single engaging structure defined on the blades 26, such as a single set of barbs 40, may suffice.

It should be appreciated that the present invention also encompasses a PCB assembly 60 (e.g., FIGS. 4 and 12) that includes one or more of the connector assemblies 10 discussed herein. For example, an exemplary PCB assembly 60 may include a printed circuit board 50 having a contact pad 52 or through-hole connection 54 footprint defined thereon, with at least one of the electrical insulation displacement connector assemblies 10 discussed above mounted on the PCB.

It should be readily appreciated by those skilled in the art that various modifications and variations can be made to the embodiments of the invention illustrated and described herein without departing from the scope and spirit of the invention. It is intended that such modifications and variations be encompassed by the appended claims.

What is claimed is:

1. A single molding electrical insulation displacement connector (IDC) assembly, comprising:

a cap body having a top side, end walls, and side walls, at least one of said side walls having a passage therethrough at a contact position for receipt of an insulated conductive core wire therein;

a contact element movably retained in said cap body with a first insulation displacement end defined by opposed blades and a second opposite end configured for electrical contact with a printed circuit board (PCB);

said contact element movable relative to said cap body from a first position wherein said opposed blades do not block insertion of the insulated core wire into said cap body through said passage to a second position wherein said opposed blades engage the insulated core wire; and wherein the insulated core wire is initially inserted into said cap body through said passage with said contact element in said first position, and said cap body is subsequently pressed towards said second end of said contact element causing said opposed blades to slide within said cap body and engage the insulated core wire.

2. The connector assembly as in claim 1, further comprising engaging locking structure between said cap body and said contact element that prevents inadvertent removal of said cap body from said contact element in said first position of said contact element yet allows sliding movement of said contact element to said second position.

3. The connector assembly as in claim 2, wherein said contact element slides within a groove defined within said cap body, said locking structure comprising a first set of barbs defined on said opposed blades.

4. The connector assembly as in claim 3, further comprising a second set of barbs defined on said opposed blades spaced from said first set of barbs at a distance so as to engage said cap body within said groove at said second position of said contact element.

5. The connector assembly as in claim 1, wherein said connector assembly is configured as a through-wire connector, wherein each of said side walls comprises a respective said passage defined therein such that a wire can pass through said connector assembly.

6. The connector assembly as in claim 1, wherein said connector assembly is configured as a wire termination connector, wherein said passage is defined in only one of said side walls such that a wire cannot pass through said connector assembly.

7. The connector assembly as in claim 1, wherein a single said contact element is disposed at said contact position.

8. The connector assembly as in claim 7, wherein said single contact element comprises oppositely extending contact feet at said second end for surface mounting to a pad on the PCB.

9. The connector assembly as in claim 1, wherein a pair of said contact elements are disposed at each said contact position with contact feet at said respective second ends for surface mounting to a common pad on the PCB.

10. The connector assembly as in claim 1, wherein said connector is a multi-wire connector further comprising a plurality of said contact elements and aligned passages in said cap body.

11. The connector assembly as in claim 1, wherein said contact element comprises through-hole termination at said second end form mounting through a hole in the PCB.

12. A printed circuit board (PCB) assembly, comprising:

a printed circuit board (PCB) having a contact pad footprint defined thereon;

at least one electrical insulation displacement connector mounted on said PCB, said connector further comprising:

a cap body having a closed top side, end walls, and side walls, at least one of said side walls having a passage therethrough at a contact position for receipt of an insulated conductive core wire therein;

a contact element movably retained in said cap body with a first insulation displacement end defined by opposed blades and a second opposite end mounted to said contact pad footprint on said (PCB);

said contact element movable relative to said cap body from a first position wherein said opposed blades do not block insertion of the insulated core wire into said cap body through said passage to a second position wherein said opposed blades engage the insulated core wire; and wherein subsequent to mounting said second end of said contact element onto said PCB, the insulated core wire is initially inserted into said cap body through said passage with said contact element in said first position, and said cap body is subsequently pressed towards said second end of said contact element causing said opposed blades to slide within said cap body and engage the insulated core wire.

13. The PCB assembly as in claim 12, further comprising engaging locking structure between said cap body and said contact element that prevents inadvertent removal of said cap body from said contact element in said first position of said contact element yet allows sliding movement of said contact element to said second position.

14. The PCB assembly as in claim 13, wherein said contact element slides within a groove defined within said cap body, said locking structure comprising a first set of barbs defined on said opposed blades.

15. The PCB assembly as in claim 14, further comprising a second set of barbs defined on said opposed blades spaced from said first set of barbs at a distance so as to engage said cap body within said groove at said second position of said contact element.

16. The PCB assembly as in claim 12, wherein said connector is configured as a through-wire connector, wherein each of said side walls comprises a respective said passage defined therein such that a wire can pass through said cap body.

17. The PCB assembly as in claim 12, wherein said connector is configured as a wire termination connector, wherein said passage is defined in only one of said side walls such that a wire cannot pass through said cap body.

18. The PCB assembly as in claim 12, wherein a single said contact element is disposed at said contact position.

19. The PCB assembly as in claim 12, wherein a pair of said contact elements are disposed at each said contact position with contact feet at said respective second ends for surface mounting to a common pad on the PCB.

20. The PCB assembly as in claim 12, wherein said connector is a multi-wire connector further comprising a plurality of said contact elements and aligned passages in said cap body.

* * * * *